United States Patent [19]

de Blois

[11] 3,997,179

[45] Dec. 14, 1976

[54] ONE-WHEEL SKATES

[76] Inventor: Joffre de Blois, 1019 Redfern St., Victoria, B. C., Canada, V8S 4E9

[22] Filed: Oct. 8, 1975

[21] Appl. No.: 620,921

[52] U.S. Cl. ..... 280/11.24; 280/11.36

[51] Int. Cl.[2] ..... A63C 17/08

[58] Field of Search ..... 280/11.24, 11.36, 11.25, 280/11.19

[56] References Cited

UNITED STATES PATENTS

| | | | |
|---|---|---|---|
| 189,285 | 4/1877 | True | 280/11.36 X |
| 584,731 | 6/1897 | Thebiay | 280/11.36 |

*Primary Examiner*—Robert R. Song
*Assistant Examiner*—Milton L. Smith
*Attorney, Agent, or Firm*—Larson, Taylor and Hinds

[57] ABSTRACT

A single wheel roller skate. The skate has an axle and a wheel rotatable on the axle. A post extends upwardly from each end of the axle. The skate has leg attachment means provided with (a) pockets that engage slidably with the posts and (b) means to enable tightening around the leg of a skater so that the wheel of the skate can be maintained in substantially fixed relationship with the leg of the skater. A foot platform receives the skater's foot and there are means to attach the platform to the skater's foot. Means to enable pivotal engagement of the platform with each post around one of two pivotal axes each of which axes is spaced from the post are provided.

5 Claims, 6 Drawing Figures

ONE-WHEEL SKATES

FIELD OF THE INVENTION

This invention relates to a one wheeled roller skate.

PRIOR ART

One wheeled roller skates are known but are difficult to control due to an inherent instability. This instability arises from the inability of the skater to maintain his weight in a proper position in relation to the wheel of the skate. The applicant seeks to provide a one wheeled skate in which when the skater's weight is forward, it is maintained in a proper relationship so that a stable platform is provided for the skater.

SUMMARY OF THE INVENTION

Accordingly the present invention is a single wheeled roller skate comprising an axle; a wheel rotatable on the axle; a post extending upwardly from each end of the axle; leg attachment means provided with (a) pockets that engage slidably with the posts and with (b) means to enable tightening around the leg of a skater so that the wheel of the skate can be maintained in substantially fixed relationship with the leg of the skater; a foot platform for the skater's foot; means to attach the platform to the skater's foot; and means to enable pivotal engagement of the platform with each post around one of two pivotal axes each of which axes is spaced from the post.

BRIEF DESCRIPTION OF THE DRAWINGS

Two embodiments of the invention are illustrated, by way of example, in the accompanying drawings in which.

DESCRIPTION OF PREFERRED EMBODIMENTS

Figure 1:
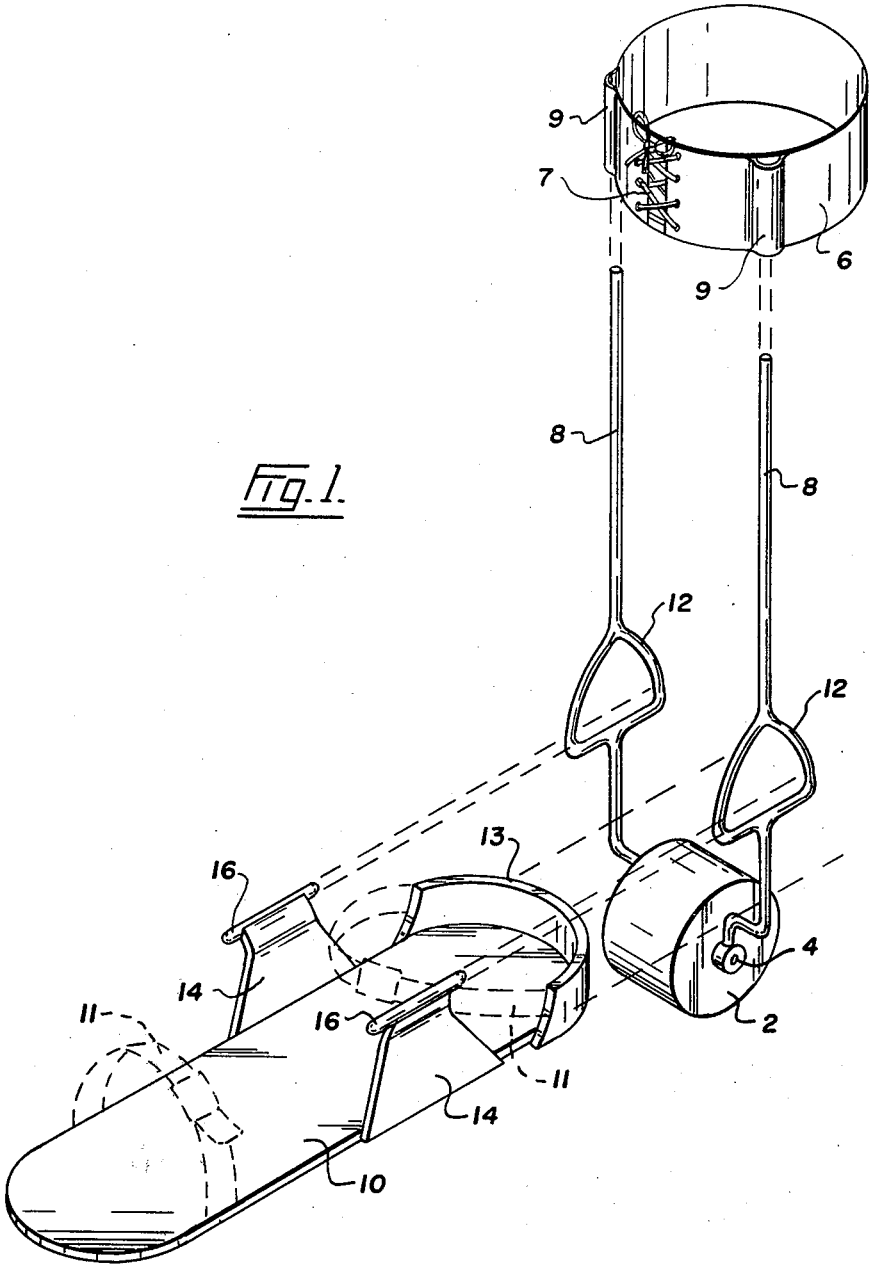
FIG. 1 is an exploded view of the first embodiment of the present invention.

FIG. 1 illustrates a single wheeled roller skate having a wheel 2 rotatable on an axle 4. The skate is provided with a leg strap 6 that is attachable to the leg of a skater. Lace 7 is used to tighten the strap 6 around the skater's leg. Two vertical posts 8 are each attached at one of their ends to the axle 4. At the other end each post 8 is slidably attached to the leg strap 6 by pockets 9.

The skate is provided with a foot platform 10 to receive a skater's foot. The skater's foot is held in position on the platform by straps 11 at the heel and toe. The foot platform 10 is provided with a heel abutment 13.

Each vertical post 8 is provided with a generally triangular engagement member 12 and the foot platform 10 is provided with stanchions 14 each of which is formed at its top with a bearing arm 16. The dimensions of the triangle 12 are such that the curved sides form arcs of circles centered on the opposite angle. Furthermore, the lengths of the arms 16 are such that they are approximately equal to the radius of such a circle and to the length of the base of the triangle 12.

Figure 2A:
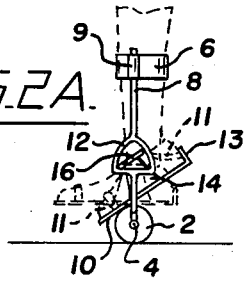
FIGS. 2A and 2B illustrate the use of the skate of FIG. 1.
Figure 2B:
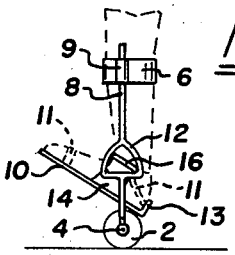

The operation of the skate of FIG. 1 is illustrated in FIGS. 2A and 2B. The rest position or starting position is shown in dotted lines in FIG. 2A. In that position the foot platform 10 is substantially parallel to the ground and the arms 16 are in contact with the bases of the triangles 12. However, as the weight of the skater is raised the arms 16 assume the position shown in FIG. 2A. That is the foot platform 10 pivots relative to the triangle 12—and thus to the leg of the skater. The skater then pushes forward as, for example, in ice skating. When the weight of the skater is back, for example, during turning then the bar 16 pivots around the rear angle of the triangle 12 as illustrated in FIG. 2B. It will be noted that the bars 16 pivot in the base angle of the triangles 12 and that they are located in this position by the other end of the bar being in contact with the opposite, substantially arcuate side of the triangle.

Figure 3:
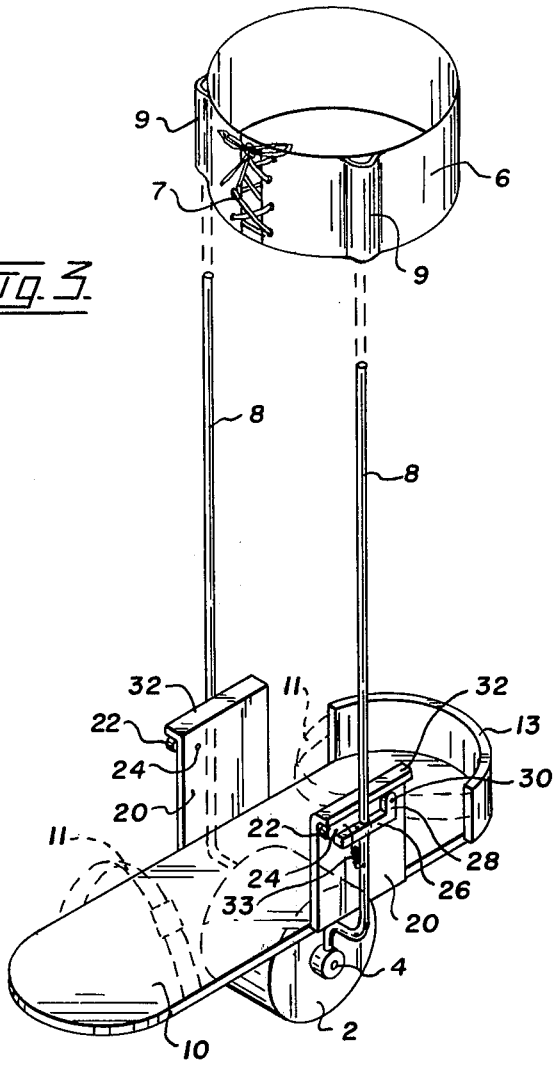
FIG. 3 is a partially exploded view of a further embodiment of the invention.

The embodiment illustrated in FIG. 3 resembles that of FIG. 1 so that the same reference numerals have been used where appropriate. Thus, the embodiment of FIG. 3 has a wheel 2, axle 4, leg strap 6 provided with a lace 7 and with pockets 9 to engage the posts 8. The foot platform 10 is provided with strap 11 and a heel abutment 13. The platform 10 is, however, formed with upwardly extending walls 20. A bar 22 adjacent the top of each wall 20 is pivoted at one end 24. An arm 26 is fixed to each vertical post 8 although, in FIG. 3, only the left hand arm 26 is shown. Arm 26 is formed with a lug 28. Lug 28, and thus the arm 26, is pivotally attached to the bar 22 at point 30. The walls 20 are provided with top flanges 32 that abut the upper side of the bars 22 and act as platforms for the foot plate 10 when the foot plate 10 is on bar 22. The skates are also provided with springs 33 only one of which is shown in FIG. 3. However, the right hand side of the skate is precisely the same as the illustrated left hand side. These springs 33 keep the bars 22 and arm 26 in contact when the weight is raised on the forward pivot point and maintain the bar 22 and arm 26 together when the skate is raised off the ground.

Figure 4A:
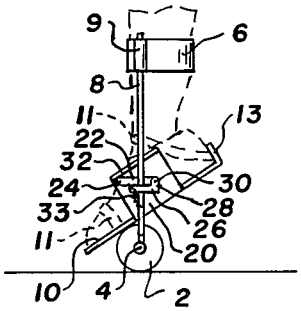
FIGS. 4A and 4B illustrate the use of the skate of FIG. 3.
Figure 4B:
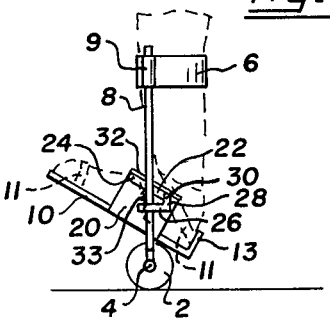

The operation of the embodiment of FIG. 3 is illustrated in FIGS. 4A and 4B. As the weight of the skater is raised on the front pivot, as illustrated in FIG. 4A, the platform 10 moves around pivot 24, that is the weight of the skater is tending to be maintained over the pivoting point. As the skater's weight is raised on the back pivot, as illustrated in FIG. 4B, the movement of bar 22 is restricted by flange 32 as the bar 22 pivots about 30 as illustrated in FIG. 4B. Thus, again, the skater's weight tends to remain over the wheel increasing the maneuverability of the skate.

The skates of the present invention are relatively simple to produce. They may be made of a wear-resistant plastic, such a nylon, or of metal. Generally speaking the strap 6 will be of leather or synthetic leather.

I claim:

1. A single wheel roller skate comprising an axle;

a wheel rotatable on the axle;

a post extending upwardly from each end of the axle;

leg attachment means provided with (a) pockets that engage slidably with the posts and with (b) means to enable tightening around the leg of a skater so that the wheel of the skate can be maintained in substantially fixed relationship with the leg of the skater;

a foot platform for supporting the skater's foot;

means to attach the platform to the skater's foot;

first pivot means attached to each post for providing a pivotal axis forwardly of said axle; and second pivot means attached to and extending upwardly from each side of said foot platform for pivotally engaging said first pivot means.

2. A skate as claimed in claim 1 wherein said first pivot means comprises a generally triangular engagement means in each post whose sides substantially form arcs of circles centered on the opposite angle and whose base, in use, is generally parallel to the ground; and wherein said second pivot means comprises bearing arms extending from the platform and, at rest, lying in contact with the base of said triangle, the ends of said arms pivotably bearing in the base angle of a triangle.

3. A skate as claimed in claim 1 in which said second pivot means comprises walls extending upwardly from said foot platform and wherein said first pivot means comprises a bar pivotably attached at a forward end thereof adjacent the top of the wall at the forward end thereof forwardly spaced from said axle, and an arm mounted on said post and pivotably attached to said bar remote from the pivotable attachment of the bar to the wall.

4. A skate as claimed in claim 3 in which the walls are formed with top flanges for engaging and limiting the upward pivoting of said bar.

5. A skate as claimed in claim 3 including springs attached to each bar and each post for tending to retain the bar and the arm in contact.

* * * * *